United States Patent [19]

Shubert

[11] 3,966,389

[45] June 29, 1976

[54] APPARATUS FOR TROWELING PIPE LINING MATERIAL

[75] Inventor: Albert Shubert, Santa Ana, Calif.

[73] Assignee: Ameron, Inc., Monterey Park, Calif.

[22] Filed: Dec. 27, 1972

[21] Appl. No.: 318,895

[52] U.S. Cl. ..... 425/460; 118/105; 425/262

[51] Int. Cl.[2] ..... B05C 3/02

[58] Field of Search ..... 118/105, 306, 408; 425/262, 460, 469

[56] References Cited

UNITED STATES PATENTS

| | | | |
|---|---|---|---|
| 2,711,000 | 6/1955 | Matheny | 425/262 |
| 2,758,352 | 8/1956 | Perkins | 425/262 |
| 3,029,779 | 4/1962 | Hornbostel | 118/119 X |
| 3,125,464 | 3/1964 | Harmes | 118/105 |
| 3,143,438 | 8/1964 | Campbell | 118/119 X |
| 3,333,311 | 8/1967 | Matheny et al. | 118/306 X |
| 3,334,389 | 8/1967 | Matheny | 425/262 |

FOREIGN PATENTS OR APPLICATIONS

| | | | |
|---|---|---|---|
| 380,451 | 8/1932 | United Kingdom | 118/DIG. 10 |

*Primary Examiner*—Morris Kaplan
*Attorney, Agent, or Firm*—Christie, Parker & Hale

[57] ABSTRACT

A frusto-conical trowel made up of a plurality of overlapping arcuate leaves includes an inflatable member within the trowel to bear against the leaves and urge them outwardly with a substantially uniform force against coating material being applied to the inside surface of a pipe.

1 Claim, 3 Drawing Figures

APPARATUS FOR TROWELING PIPE LINING MATERIAL

BACKGROUND OF THE INVENTION

This invention relates to troweling apparatus for applying a protective coating of cement mortar or similar material to the inside surface of pipe.

The application of mortar or similar plastic material to the interior surfaces of pipelines already in place has been used for a number of years to recondition and protect the interior surface of pipes.

A successful type of coating applicator and troweling apparatus is disclosed in U.S. Pat. No. 3,333,311. That patent discloses a mortar-dispensing machine which precedes a frusto-conical trowel towed by the dispenser. The trowel in that patent is made up of a plurality of arcuate leaves which overlap circumferentially to form an expandable troweling edge at the larger and trailing end of the trowel. The leaves are urged outwardly by an annular coil spring inside the trowel. The patented trowel does a good job in pipelines of relatively small diameter, but difficulties are encountered in trying to use the patented pipe trowel to line pipes having an interior diameter of more than about 24 inches. The annular compression spring is so large and heavy that it increases the weight of the trowel and causes excessive pressure on the lining material at the bottom of the pipe, thereby resulting in uneven lining thickness. Another disadvantage is that the weight of the spring causes it to sag away from the trowel leaves across the upper portion of the pipe. Thus, the spring does not exert an equal pressure on the upper leaves in the trowel, further aggravating the uneveness of the lining thickness. Attempts to avoid the problems caused by the large annular spring have included the use of individual short springs at each joint where the leaves overlap. This was unsuccessful in large diameter trowels, because the relatively large span in the arc of the individual leaves causes buckling of the leaves so that they do not exert a uniform pressure around the entire circumference of the troweling edge. To alleviate that difficulty, the number of leaves on the troweling device were increased to shorten the arcuate span of each individual leaf to avoid buckling. The increased number of leaves is undesirable because it requires more parts, and each overlap between adjacent leaves tends to leave a ridge in the coating material after the trowel passes. This is undesirable because the purpose of the lining operation is to provide the smoothest possible surface for minimum friction losses when the lined pipe is placed in service.

The present invention eliminates the weight and sag problem of the large annular spring, and the tendency for the trowel leaves to buckle without increasing the number of leaves.

SUMMARY OF THE INVENTION

Briefly, this invention provides an improved frusto-conical trowel for spreading a layer of protective coating material on the inside of a pipe. The trowel includes a plurality of circumferentially overlapping arcuate leaves. An inflatable member is disposed within the trowel to bear against the leaves and urge them outwardly with a substantially uniform force against the protective coating material. Preferably, the inflatable material is an annular elastic tube, such as a bicycle tire inner tube or the like. The tube is held in place by lightweight, longitudinally extending rods secured at one end to the tube, and at the other end to the interior portion of the frusto-conical trowel where it is of smaller diameter. The inflatable tube is relatively lightweight compared to the circular compression spring previously used, and therefore does not significantly increase the weight of the trowel. Moreover, the tube makes a smooth fit against the interior surfaces of the trowel leaves so that they are urged outwardly with a uniform force, thereby preventing buckling, regardless of the arcuate span of each individual leaf. Accordingly, the trowel can be manufactured with a minimum number of leaves to minimize the ridges which tend to be formed at the overlapping joints of adjacent leaves.

DESCRIPTION OF THE PREFERRED EMBODIMENT

Figure 1:
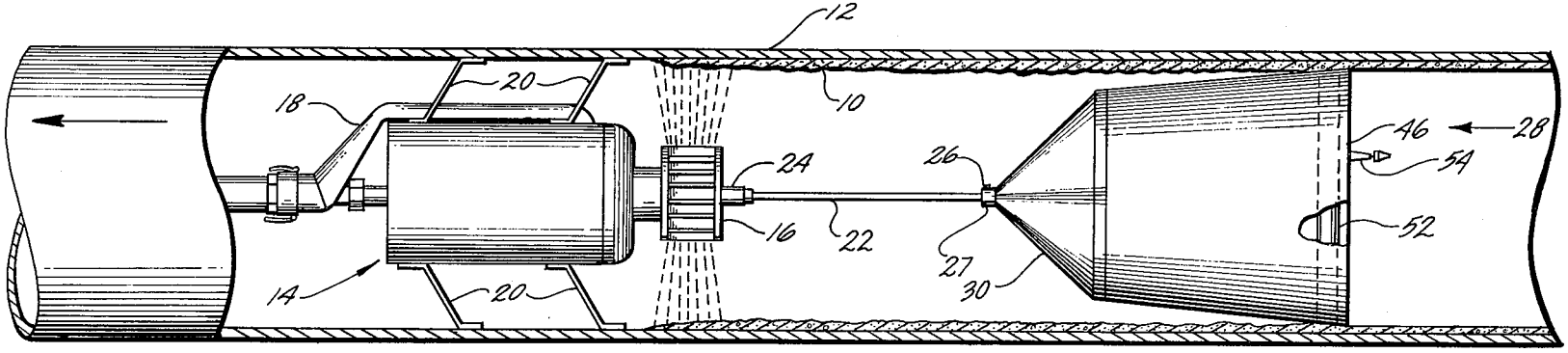
FIG. 1 is a side elevation, partly broken away, of a pipelining machine using the improved trowel of this invention.
Figure 3:
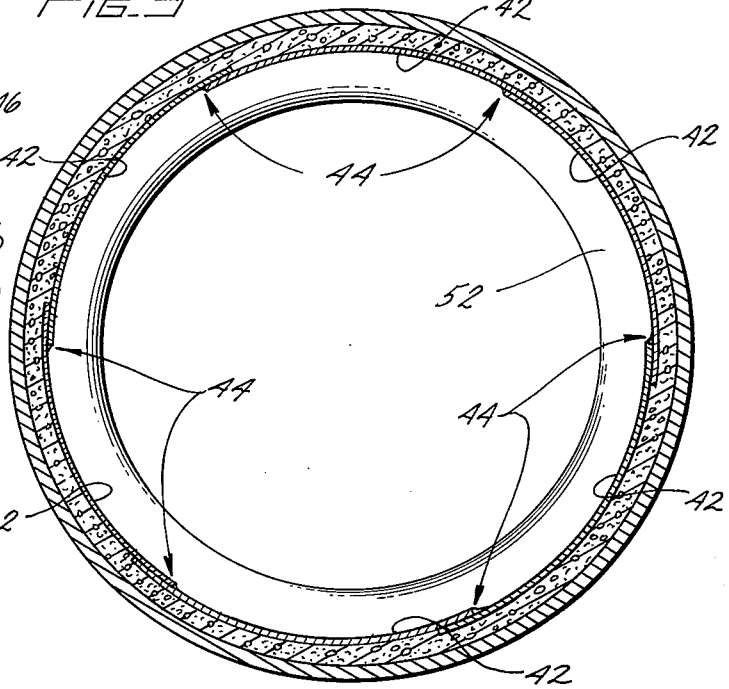
FIG. 3 is a view, slightly enlarged, taken on line 3—3 of FIG. 2.

Referring to FIG. 1, a layer of plastic cement mortar 10 is applied to the inside surface of a pipe 12 by a pipelining machine 14. A dispensing head 16 rotates about a horizontal axis to sling fresh mortar against the interior surface of the pipe. The pipelining machine is supplied mortar through a hose 18, and is pulled from right to left (as viewed in FIG. 1) by any suitable means (not shown). Spider legs 20 are secured around the periphery of the pipelining machine, and bear against the interior surface of the pipe to center the machine.

A longitudinally extending horizontal flexible shaft 22 is secured at its forward end by a swivel joint 24 to the pipelining machine just aft of the dispensing head by the head. Thus, the shaft does not rotate with the head. The rear end of the shaft is secured by a set screw 26 to a nose hub 27 at the forward end of a frusto-conical trowel 28. The flexible shaft allows the lining machine to maintain a position along the center line of the pipe as the machine is pulled.

Figure 2:
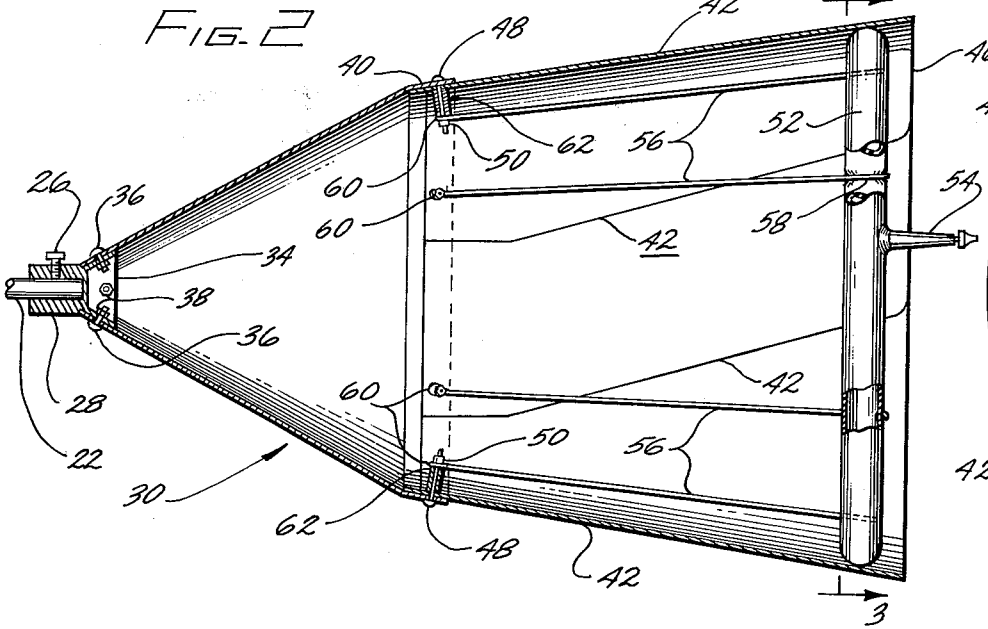
FIG. 2 is a sectional elevation of the improved trowel.

As shown in detail in FIG. 2, the troweling device includes a frusto-conical nose section 30 which extends outwardly and rearwardly from the nose hub, which has an outwardly and rearwardly extending annular flange 34 secured by screws 36 and nuts 38 to the forward end of the nose section. The rear end of the nose section includes an annular skirt 40 tapered to extend rearwardly and outwardly at a smaller angle than the forward part of the nose section. A plurality of arcuate leaves 42 are disposed so that the longitudinally extending edges of adjacent leaves overlap to form joints 44 at equally spaced intervals around the circumference of the trowel. The trailing edges of the leaves form a circular troweling edge 46.

The forward end of each leaf is secured to the annular skirt 40 of the trowel nose section by a separate respective screw 48 and nut 50 so that each leaf is free to pivot slightly about the longitudinal axis of its respective screw, and thereby vary the circumference of the troweling edge to accommodate pipes of various internal diameters. An annular inflatable tube 52 is disposed within the trowel adjacent the troweling edge. The tube has a major diameter D, which is substantially greater than its minor diameter *d*. The tube is inflated through a conventional valve stem 54 to expand against the interior of the leaves so they are urged outwardly with a uniform force against the layer of mortar which is to be troweled to a smooth surface as the troweling machine is pulled through the pipe. The inflated tube is held in place by a plurality of longitudinally extending rods 56. A loop 58 at the rear end of each rod fits around the tube at equally spaced intervals. The forward end of each rod is bent in the shape of an eye 60 and is secured by a respective screw 48 between the nut 50 on the screw and the inner end of an annular spacer 62 disposed around the screw between the inner surface of the leaf and the rod eye.

In using the improved trowel of this invention to line a pipe with cement mortar, the machine is operated in the conventional fashion to deposit a layer of fresh mortar on the interior of the pipe surface. As the machine is pulled through the pipe, the troweling edge produces a smooth finish to the mortar, even though the pipe diameter may be relatively large, say 40 to 60 inches, because the pneumatic tube is inflated to the required pressure to apply the necessary uniform force to the trowel leaves to produce a lining with a smooth surface and of uniform thickness. Even though the trowel may be relatively large in diameter, its weight is not inordinately increased by the pneumatic tube. Minimization of weight of the troweling device in the vicinity of the troweling edge is further effected by the use of the tube mounting rods which are secured to the trowel well forward of the troweling edge. Thus, the mortar at the top and bottom of the pipe receives substantially the same troweling action. Moreover, the trowel leaves are prevented from buckling because of the uniform pressure applied by the tube around the entire inner circumference of the trowel adjacent the troweling edge. This permits the use of leaves with relatively large arcuate spans, thereby minimizing the number of leaves and ridges left in the finished surface of the mortar lining.

Although the inflatable member used to spread the trowel leaves is shown as an inflatable annular tube, any suitable inflatable bag or other type member can be used so long as its weight does not become a problem, and provided it gives necessary support to the arcuate leaves to prevent buckling.

I claim:

1. An improved frusto-conical trowel for spreading a smooth layer of protective coating material on the inside of a pipe, the trowel comprising a plurality of circumferentially overlapping arcuate leaves, an inflatable annular elastic tube member disposed within the trowel adjacent its larger end to bear against the leaves and urge them outwardly with a substantially uniform force against the protective coating material, the annular tube having a major diameter substantially greater than its minor diameter, and a plurality of longitudinally extending rods each secured at one end to the tube and at the other end to a portion of the trowel of smaller diameter.

* * * * *